US005162848A

United States Patent [19]

Saitoh et al.

[11] Patent Number: 5,162,848

[45] Date of Patent: Nov. 10, 1992

[54] TONER EMPTY DETECTING SYSTEM

[75] Inventors: Susumu Saitoh; Nobuo Ihata; Kazuyuki Ono, all of Ibaraki, Japan

[73] Assignee: Hitachi Koki Co., Ltd., Tokyo, Japan

[21] Appl. No.: 654,892

[22] Filed: Feb. 13, 1991

[30] Foreign Application Priority Data

Feb. 16, 1990 [JP] Japan ..... 2-14836[U]

[51] Int. Cl.[5] ..... G03G 21/00

[52] U.S. Cl. ..... 355/206; 118/694; 355/246

[58] Field of Search ..... 355/245, 246, 208, 209, 355/308, 309, 205, 206, 207; 118/689, 690, 691, 694

[56] References Cited

U.S. PATENT DOCUMENTS

| | | | |
|---|---|---|---|
| 4,669,856 | 6/1987 | Yamada | 355/246 X |
| 4,742,372 | 5/1988 | Takahashi | 355/246 |
| 4,803,513 | 2/1989 | Nishise et al. | 355/245 X |
| 4,934,314 | 6/1990 | Ideyama | 118/689 |
| 4,952,976 | 8/1990 | Katoh et al. | 355/246 X |
| 4,987,449 | 1/1991 | Katoh | 355/206 |

FOREIGN PATENT DOCUMENTS

| | | | |
|---|---|---|---|
| 0126552 | 10/1979 | Japan | 118/689 |
| 0106481 | 5/1987 | Japan . | |

*Primary Examiner*—A. T. Grimley
*Assistant Examiner*—Robert Beatty
*Attorney, Agent, or Firm*—Cushman, Darby & Cushman

[57] ABSTRACT

A toner empty detecting system for use in an electrophotographic printer. A sensor detects the presence of toner and provides toner-empty or toner-present signals. A first counter is incremented when toner-empty signals are detected at pre-determined time intervals and the first counter is cleared when a toner-present signal is detected. When the first counter reaches a predetermined value (first occurrence), the first counter is cleared and a second counter counts the number of printed pages until the first counter again reaches the same predetermined value (second occurrence). An indicator signals the first and second occurrence. Upon the second occurrence, the values of the first counter, second counter and indicator are compared and a comparison signal is provided. The printing is stopped if the comparison signal indicates that an actual toner-empty condition exists and the toner empty condition is displayed.

2 Claims, 2 Drawing Sheets

TONER EMPTY DETECTING SYSTEM

BACKGROUND OF THE INVENTION

1. Field of the Invention

This invention relates to a toner empty detecting system for use in an electrophotographic printer or the like.

2. Description of the Related Art

In a conventional electrophotographic printer, when the residual quantity of a toner becomes less than a predetermined amount (this condition will hereinafter be referred to as "toner-empty condition"), the quality of the print copies deteriorates. Therefore, generally such a printer is provided with means for detecting the toner-empty condition. In order to ensure a satisfactory printing quality, the detection of the toner-empty condition must be performed correctly.

A conventional toner empty detecting system of an electrophotographic printer will now be described with reference to a block diagram of FIG. 3 (prior art) and a flow chart of FIG. 4 (prior art). During printing, a controller 1 monitors the output of a toner sensor 3 mounted within a developing machine 2 at predetermined time intervals T. When a toner-empty signal is detected (Step 401), the controller 1 increments a counter 4 (Step 402) and when a toner-present signal is detected, the controller 1 clears the counter 4 (Step 403). The controller 1 repeats this operation of incrementing and clearing the counter 4 until the count of the counter 4 is able to reach a certain value N1 (Step 404) because no toner-present signals were detected during a given time period. Then, the controller judges that the toner-empty condition exists, stops the printing (Step 405), and instructs a display device 5 to display the toner-empty condition (Step 406).

Typically, the fluidity of the toner is deteriorated by moisture or the like so that the toner in the developing machine 2 may decrease unevenly. In such a case, only the toner on the surface of the toner sensor 3 deteriorates, therefore, the toner sensor may erroneously detect the toner-empty condition.

When the toner-empty condition is detected even though the toner still remains, the operator generally does not realize that toner still remains, and therefore feeds a fresh supply of toner in accordance with the toner-empty message. As a result, the added toner may exceed the capacity as allowed for by the developing machine 2 and overflow.

SUMMARY OF THE INVENTION

It is an object of this invention to provide a toner empty detecting system which more accurately detects the toner-empty condition. This object has been achieved by a toner empty detecting system comprising a developing machine, a toner sensor for detecting a toner within said developing machine and a counter for monitoring an output of the toner sensor at predetermined time intervals. The counter increments when a toner-empty signal is detected and is cleared in response to a toner-present signal. Display means display a toner-empty condition when a predetermined printing operation is stopped.

The present invention further comprises a printed-page counter which counts the number of printed pages during a time period and clears upon reaching a predetermined count. When this predetermined count is reached, the counter resets and again counts printed pages until the predetermined count is reached again. A flag signal is then set and it is determined whether the toner-empty condition truly exists by evaluating the state of the flag signal and the printed page counter outputs in accordance with the toner sensor output counter.

The present invention operates on the following principle: When the fluidity of the toner becomes uneven for a brief period of time due to moisture or the like, the fluidity of the toner within the developing machine will regain uniformity if the machine operates for a brief period of time, therefore, a toner empty signal should not be displayed. However, when the remaining quantity of toner actually becomes small and requires additional toner, the toner-empty condition lasts for a longer period of time and this extended period of time is distinguished as indicating a genuine need for toner replacement. Furthermore, even when the time required to verify the actual need for toner replacement delays as long as 10 seconds, the printing quality is hardly affected.

Therefore, if the toner-empty signal is detected for a predetermined period of time, the toner-empty condition is not decided until the conditions of the printed page counter output and flag output are checked. As a result of this additional checking, the toner-empty condition is determined with more accuracy.

BRIEF DESCRIPTION OF THE DRAWINGS

Preferred embodiment(s) of the invention will be described in detail with reference to the drawings wherein like reference numerals denote like or corresponding parts throughout.

DETAILED DESCRIPTION OF THE PREFERRED EMBODIMENT

Figure 1:
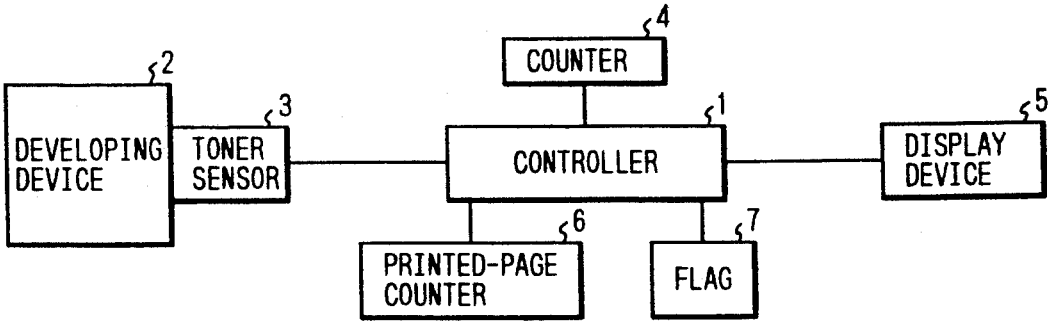
FIG. 1 is a block diagram of a preferred embodiment of a toner-empty detecting system of the present invention.
Figure 2:
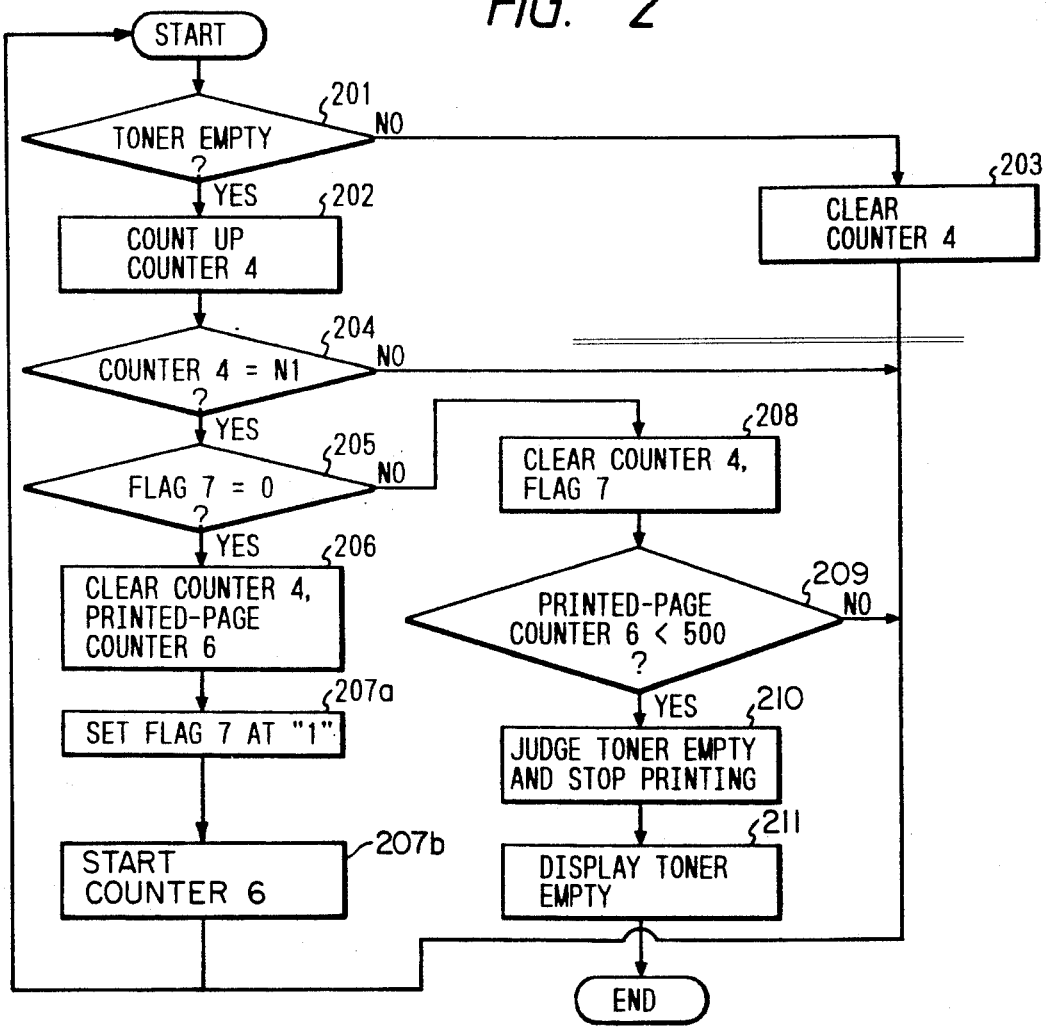
FIG. 2 is a flow chart representing the operation of the system of FIG. 1.
Figure 3:
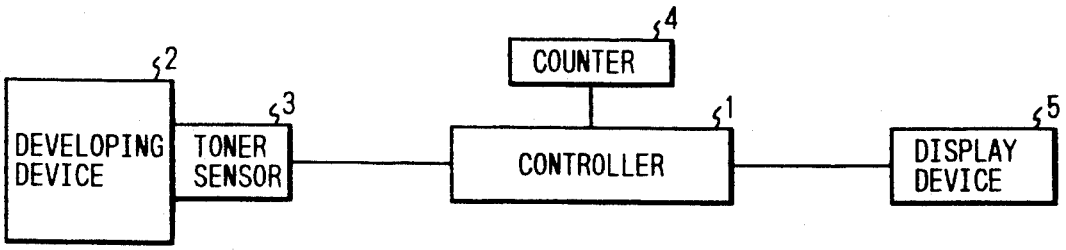
FIG. 3 (PRIOR ART)
FIG. 3 (prior art) is a block diagram of a conventional toner empty detecting system.
Figure 4:
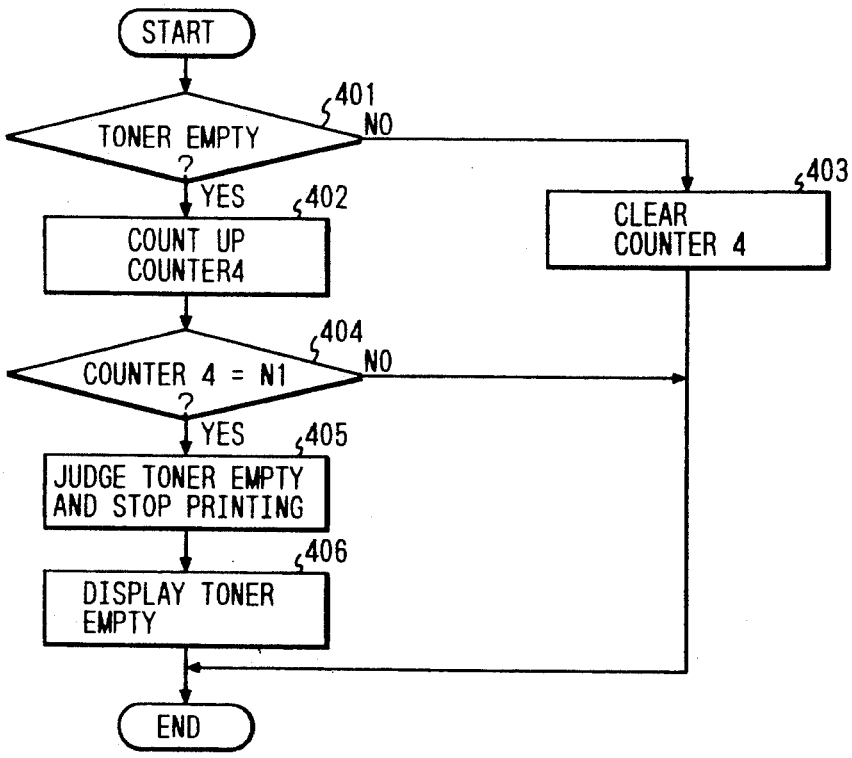
FIG. 4 (PRIOR ART)
FIG. 4 (prior art) is a flow chart representing the operation of the system of FIG. 3.

One preferred embodiment of a toner-empty detecting system of the present invention is described with reference to a block diagram of FIG. 1 and a flow chart of FIG. 2. The system of FIG. 1 differs from the conventional system of FIG. 3 (prior art) in that a printed-page counter 6 and a flag 7 are connected to a controller 1. During printing, the controller 1 monitors the output of a toner sensor 3 mounted within a developing machine 2 at predetermined time intervals T (for example, at time intervals of 10 msec.). If a toner-empty signal is detected (Step 201), the controller 1 increments counter 4 (Step 202). If a toner-present signal is detected, the controller 1 clears the counter 4 (Step 203). This operation is repeated. Each time the count of the counter 4 reaches a predetermined count N1 (for example, 1250) (Step 204), that is, each time the invention detects that the toner-empty signal is uninterrupted by a toner present signal for a time period of $T \times N1 = 12.5$ sec., the controller 1 judges, in accordance with the value of the flag 7 and the value of the printed-page counter 6, whether or not the toner-empty condition actually exists.

The flag 7 indicates whether the detection of the toner-empty signal for the above time period $T \times N1 = 12.5$ sec. has occurred for the first or second time (hereinafter first occurrence and second occurrence). For example, when the count of the counter 4 reaches a certain value (i.e., 1250) when . the value of the flag 7 is a certain value (i.e., "0") (Step 205), this is determined to be a first occurrence. When the value of the flag 7 is another value (i.e., "1") and counter 4 again reaches the same certain value, this is determined to be a second occurrence.

At the time of the first occurrence, the controller 1 clears the counter 4 and the printed-page counter 6 (Step 206), and sets the flag, 7 at a certain value (i.e., "1") (Step 207a). At this time, the toner-empty condition is determined not to exist and the printing continues. The printed-page counter 6 then counts the number of printed pages (Step 207b) until the second occurrence. At the time of the second occurrence, the controller 1 clears the counter 4 and the flag 7 (Step 208) and determines that the toner-empty condition exists if the count of the printed-page counter 6 is in accordance with a predetermined value requirement (i.e., less than 500 pages) (Step 209). Upon determination that the toner-empty condition exists, printing is stopped (Step 210). Also, the controller 1 instructs the display device 5 to display a signal indicating that the toner empty condition exists (Step 211). However, if the count of the printed-page counter 6 goes beyond the predetermined value requirement (i.e. more than 500 pages), the controller 1 determines that the toner-empty condition does not exist and the printing continues.

As indicated in the present invention, even if the toner sensor detects that the toner-empty signal lasts for a predetermined period of time, the toner empty is not immediately decided. Therefore, the toner-empty condition is detected with more accuracy.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A toner empty detecting system comprising:

a developing machine;

first means for detecting a presence of toner within said developing machine and providing signals indicative thereof;

first means for counting to a predetermined value, said first counting means being cleared when one of a first and a second predetermined condition occurs;

second means for detecting an output of said first detecting means at predetermined time intervals, said second detecting means incrementing said first counting means when a toner-empty signal is detected, and said second detecting means clearing said first counting means when said first predetermined condition occurs, said first predetermined condition being when a toner-present signal is detected;

second means for counting a number of printed pages during a predetermined period, said predetermined period beginning when said second predetermined condition occurs, said second predetermined condition being when said first counting means is equal to said predetermined value and is cleared, said predetermined period ending when said first counting means again is equal to said predetermined value;

means for indicating a first occurrence and a second occurrence of said first counting means being equal to said predetermined value;

means for comparing said first counting means, said second counting means and said indicating means and providing signals indicative thereof;

means for interrupting a printing operation of said developing machine in accordance with said signals provided by said comparing means; and means for displaying a toner-empty signal in accordance with said signals provided by said comparing means.

2. A method for detecting a toner empty condition comprising the steps of:

detecting a presence of toner in a developing machine and providing signals indicative thereof;

detecting said signals at predetermined time intervals, incrementing first counting means when said signals are toner-empty signals and clearing said first counting means when said signals are toner-present signals;

clearing said first counting means when said first counting means equals a predetermined value and incrementing a second counting means in accordance with a number of printed pages until said first counting means again is equal to said predetermined value;

providing indicating signals indicative of a first and a second occurrence of said first counting means reaching said predetermined value;

comparing said first counting means, said second counting means and said indicating signals and providing comparison signals indicative thereof;

interrupting a printing process of a developing machine in accordance with said comparison signals; and displaying toner-empty condition signals in accordance with said comparison signals.

* * * * *